US005946863A

United States Patent [19]

Bullard

[11] Patent Number: 5,946,863

[45] Date of Patent: Sep. 7, 1999

[54] REPLACEMENT FLASHING FOR WEATHERHEAD

[76] Inventor: Robert D. Bullard, 455 Jones Rd., Blountsville, Ala. 35031

[21] Appl. No.: 09/034,155

[22] Filed: Mar. 2, 1998

[51] Int. Cl.[6] ..... E04B 7/00

[52] U.S. Cl. ..... 52/58; 52/60; 52/198; 285/42

[58] Field of Search ..... 52/58, 60, 97, 52/198–199, 85, 716.5, 219; 285/42–44, 424

[56] References Cited

U.S. PATENT DOCUMENTS

| | | | |
|---|---|---|---|
| 4,664,390 | 5/1987 | Houseman | 52/58 X |
| 4,897,974 | 2/1990 | Lane | 52/199 |
| 4,937,991 | 7/1990 | Orth | 52/199 |
| 5,226,263 | 7/1993 | Merrin | 52/58 |
| 5,390,451 | 2/1995 | Kopp | 52/58 |
| 5,414,964 | 5/1995 | Bodycomb | 52/58 |

*Primary Examiner*—Beth Aubrey
*Attorney, Agent, or Firm*—Waddey & Patterson, P.C.; John C. Garvin, Jr.

[57] ABSTRACT

A prefabricated flashing for a weatherhead or other pipe which protrudes through roofs of structures such as a house to prevent rain or water seepage and which is adaptable to conform when assembled to any customary degrees of roof inclinations. The flashing includes an upper half of flashing and a lower half of flashing, each of which has a lip that can be easily secured together to surround a portion of the weatherhead or other pipe which protrudes through the roof. A clamping mechanism is provided for securing the upper half of flashing and lower half of flashing to the weatherhead.

19 Claims, 5 Drawing Sheets

REPLACEMENT FLASHING FOR WEATHERHEAD

FIELD OF THE INVENTION

The present invention relates generally to a roofing flashing, and more particularly to a flashing for replacing the existing flashing which surrounds a weatherhead protruding through a roof and which provides electricity to a home when new roof shingles are being placed upon the home.

BACKGROUND OF THE INVENTION

When new shingles are being placed upon the roof of a home, the roofers normally replace all flashing which surround, at least in part, chimneys, and pipes which protrude through the roof except for the flashing which surrounds the weatherhead which provides electricity to the home. This is so because the electrical lines which lead to the home provide obstacle to roofers in the replacement of conventional one-piece flashing on the roof, under the shingles, which surrounds the weatherhead. To remove the electrical lines leading to the home, the roofers must contact the utility company to disconnect the electrical lines before replacing the weatherhead flashing and again contacting the utility company to connect the electrical lines after the new flashing and roof is placed upon the house. Due to this inconvenience, roofers rarely replace the flashing around the weatherhead when new roof shingles are placed upon a house. The failure to replace the weatherhead flashing often causes leaks or water seepage around the weatherhead due to the deteriorated condition of the unreplaced flashing.

SUMMARY OF THE INVENTION

This invention relates to a ready-made replacement flashing for a weatherhead or other pipes which protrudes through roofs of a structure such as a house to prevent rain or water seepage around the joint between the weatherhead and the roof. The flashing of the present invention is preferably made of light weight metal or any other suitable material and of simple construction having parts adaptable to conform when assembled to any customary degrees of roof inclinations. It is prefabricated so that it can be easily and readily assembled on the job.

The flashing of the present invention includes an upper half of the flashing and a lower half of the flashing, each of which has lip portions which can be easily secured together to surround a portion of an electrical weatherhead which protrudes through the sloped roof of a structure such as a house. The flashing further includes a simple clamping mechanism for securing the two-piece flashing to the weatherhead to provide a water tight seal between the weatherhead and the flashing.

The flashing of the present invention overcomes the drawbacks and deficiencies of prior art weatherhead flashings by providing the roofer a simple, economical, easily assembled, flashing that can be adapted to existing roofs with slopes of between 15 degrees and 75 degrees without necessitating any special cutting or shaping. The replacement weatherhead flashing of the present invention allows a roofer to cut-up or destroy the old one-piece weatherhead flashing to remove it and allows the roofer to easily replace the old flashing with the improved replacement flashing without being concerned with the inconvenience of having to contact the utility company at least twice.

A principal object of the present invention is to provide the roofer with a practical weatherhead flashing adaptable to all roof pitches.

Another object of the present invention is to provide a weatherhead flashing of easily assembled construction that can be installed without the need of utilizing specialized labor or tools.

A further object of the present invention is to provide a flashing for an electrical weatherhead which allows the roofer to replace the flashing without requiring the disconnection and reconnection of electrical wires leading to the weatherhead.

Additional objects and advantages of the present invention will be apparent to those skilled in the art to which the invention pertains from the following description of the preferred embodiment thereof with reference to the accompanying drawings.

DETAILED DESCRIPTION OF THE PREFERRED EMBODIMENTS

Figure 2:
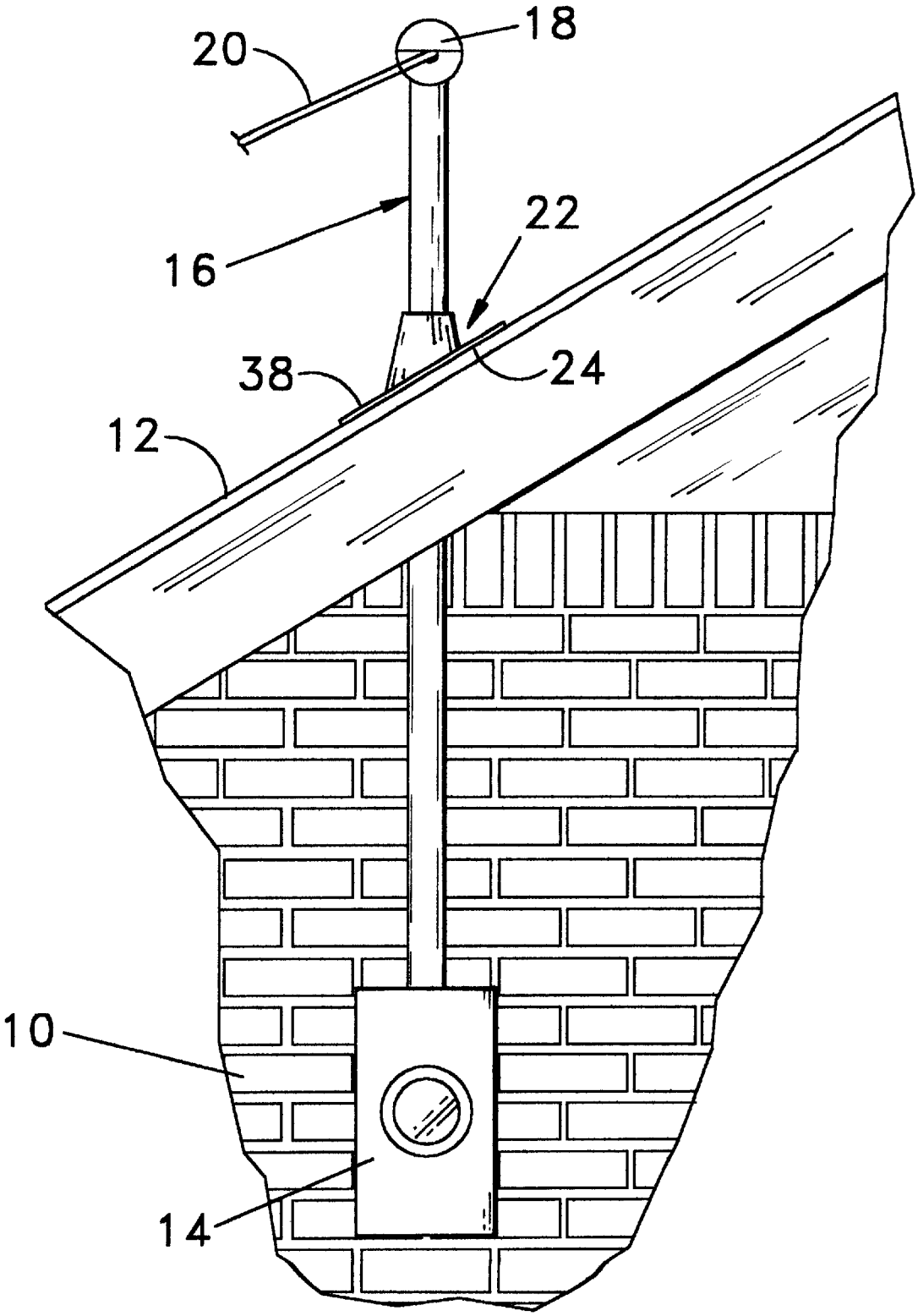
FIG. 2 is a partially broken away, side elevational, view of a structure having the flashing of the present invention mounted on its sloped roof and surrounding a portion of a weatherhead protruding through the roof of the house.

With reference first to FIG. 2 of the drawings, the preferred embodiment of the replacement weatherhead flashing 22 of the present invention is thereshown on a house 10 having a roof 12, an electric meter box 14, a weatherhead 16 protruding through the roof 12, a coupling 18 at the top of the weatherhead 16, and wires 20 leading from a utility pole (not shown) through coupling 18 to the weatherhead 16 and meter box 14.

Figure 1:
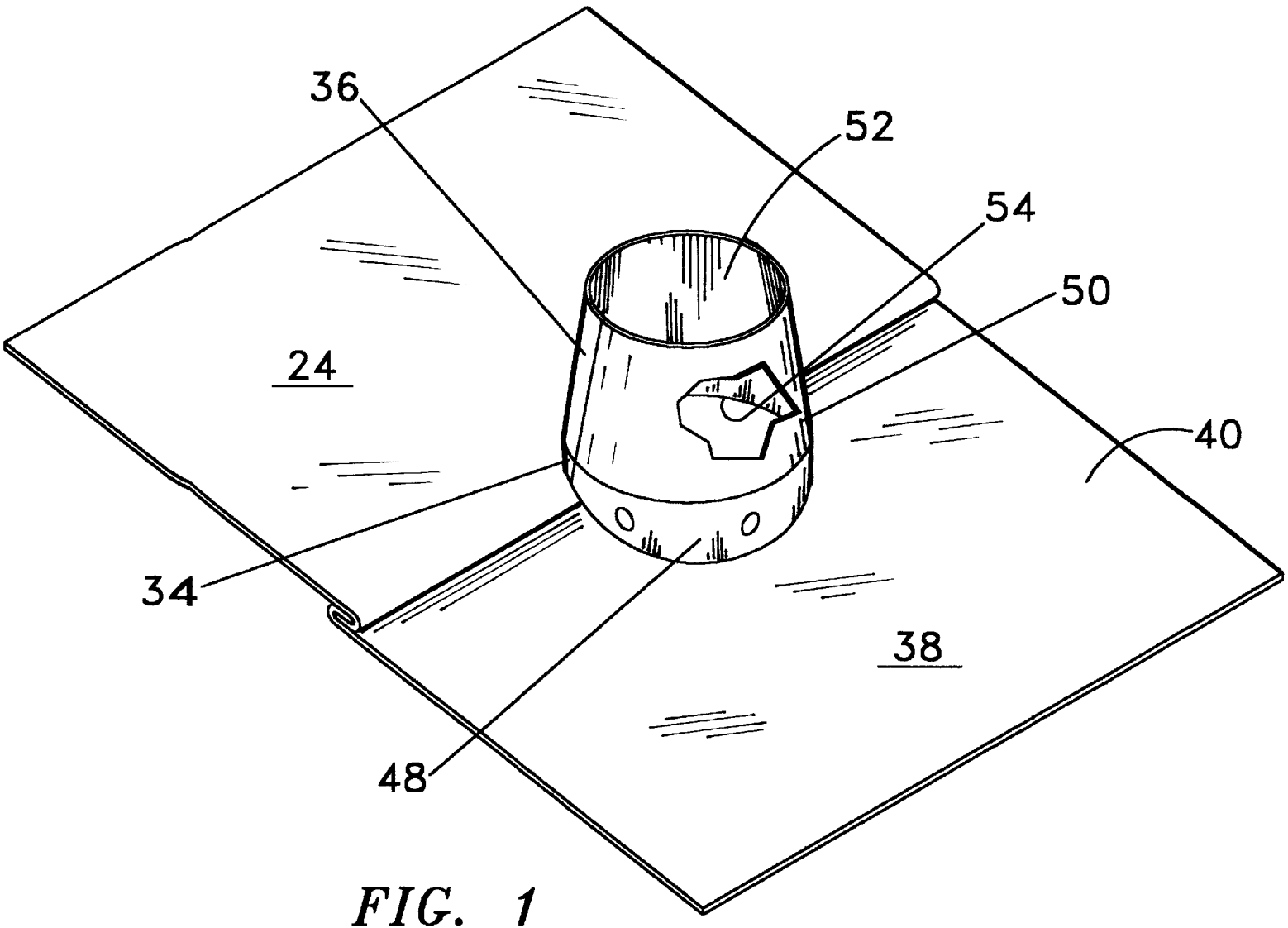
FIG. 1 is a perspective view of the flashing of the present invention.
Figure 3:
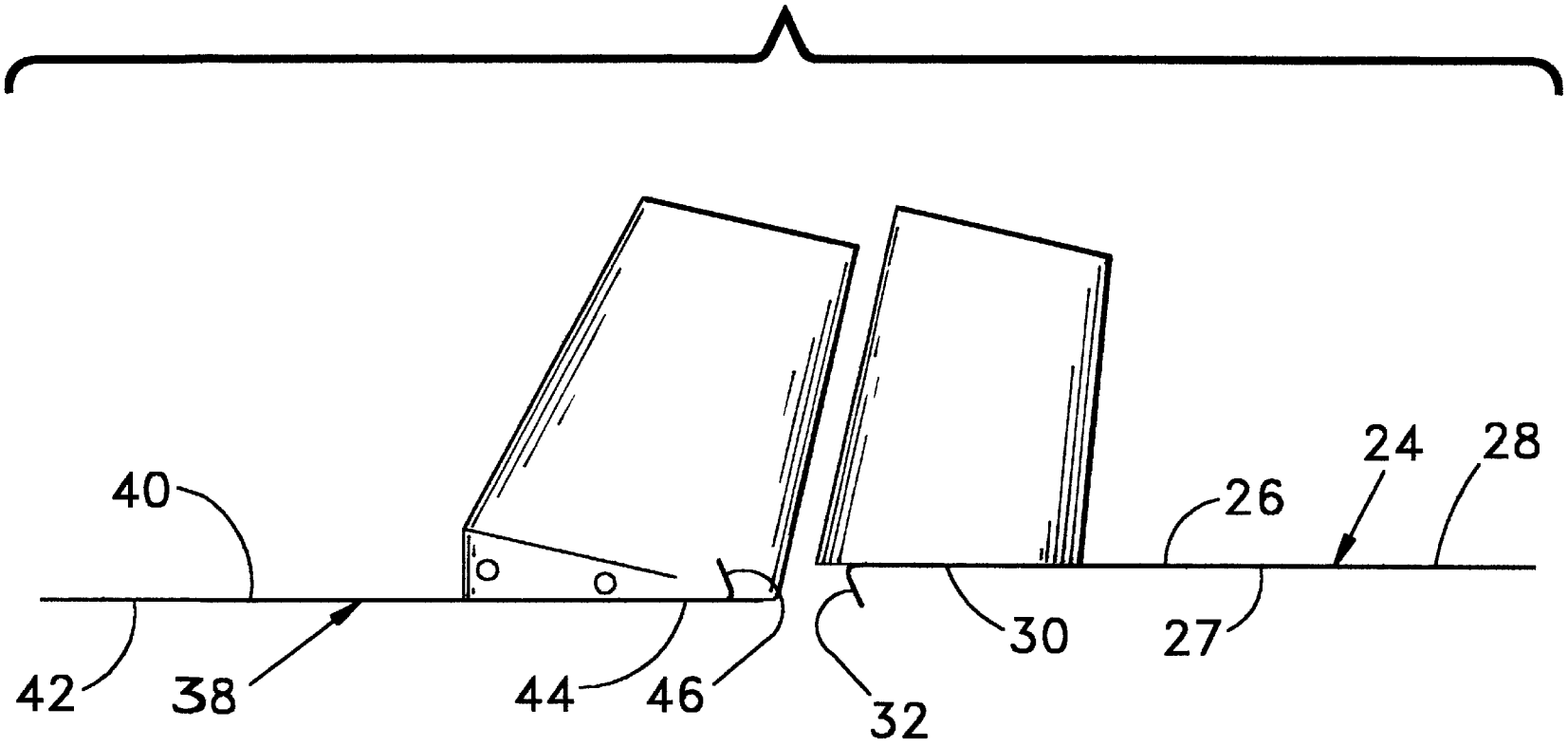
FIG. 3 is an exploded, side elevational, view of the replacement flashing of the present invention.
Figure 4:
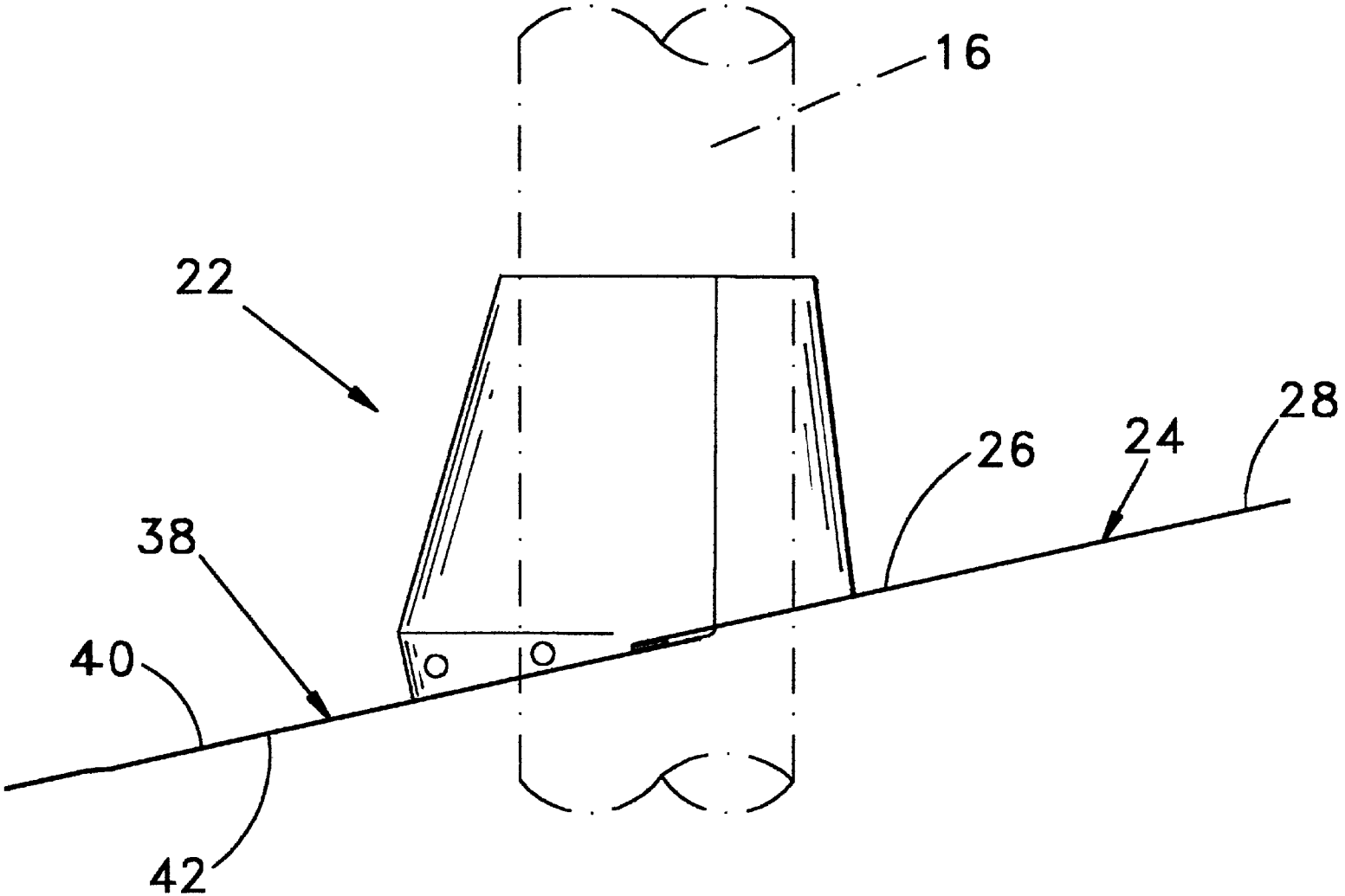
FIG. 4 is a side elevational view of the replacement flashing of the present invention secured together and surrounding a portion of the weatherhead which protrudes through the roof of a structure, but without a clamping mechanism.
Figure 5:
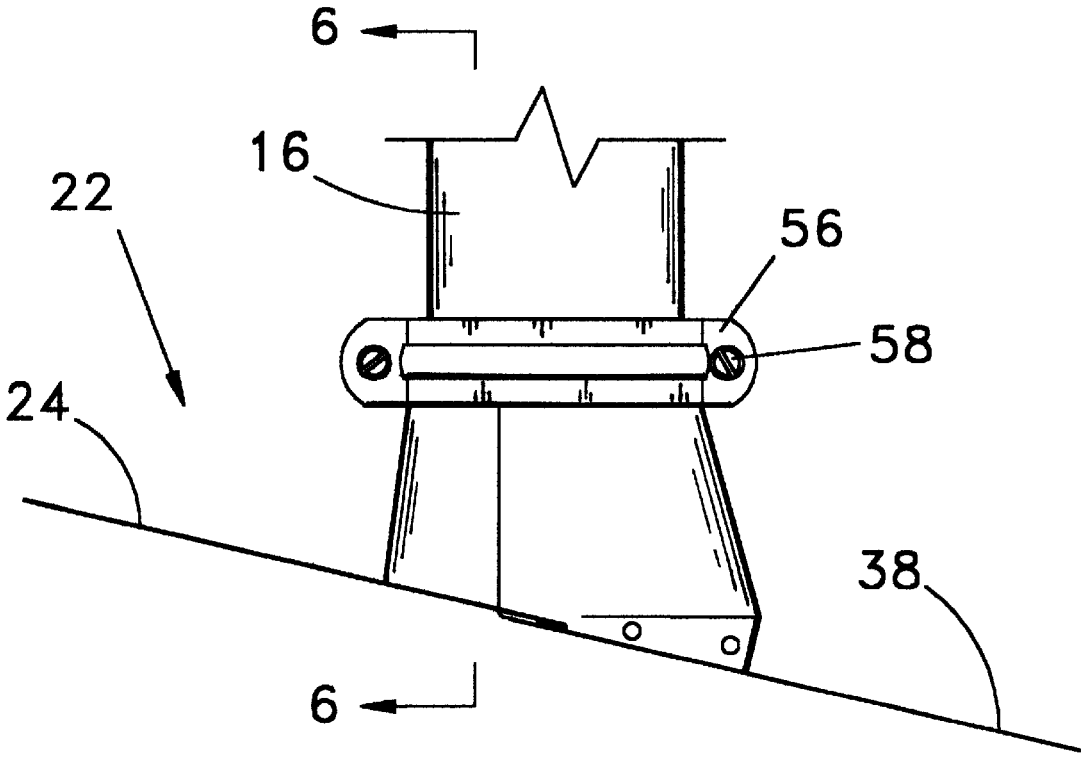
FIG. 5 is a side elevational view of the replacement flashing of the present invention secured together and clamped to the weatherhead which protrudes through the roof of the structure.
Figure 6:
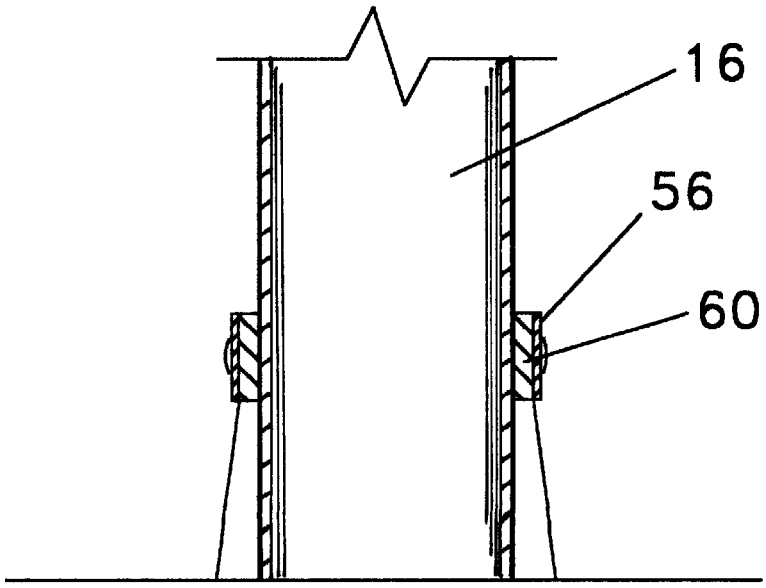
FIG. 6 is a sectional view taken substantially along line 6—6 of FIG. 5.

With particular reference to FIGS. 1 and 3, weatherhead flashing 22 comprises an upper half of flashing 24 having an upper surface 26, a lower surface 27, an upper portion or edge 28, a lower portion or edge 30 with a downwardly extending bent lip 32, a first semi-cylindrical flange 34, and a second semi-cylindrical flange 36; a lower half of flashing 38 having an upper surface 40, a lower surface 42, an upper portion or edge 44 with an upwardly extending bent lip 46, a first semi-cylindrical flange 48, and a second semi-cylindrical flange 50. When assembled to surround a portion of the weatherhead 16, as best shown in FIG. 1, a generally cylindrical upper opening 52 and a generally oblong lower opening 54 are formed in the flashing 22. As best seen in FIGS. 5 and 6, a two-piece, C-shaped clamp 56, nuts and bolts 58 and a rubber gasket 60 are provided to seal the flashing 22 to the weatherhead 16 and roof 12. As best seen in FIGS. 3 and 4, the first semi-cylindrical flange 34 and second semi-cylindrical flange 36 of upper half of flashing 22 and the first semi-cylindrical flange 48 and second semi-cylindrical flange 50 of lower half of flashing 38 are secured together by spot welds (unnumbered) or any other conventional means.

The replacement weatherhead flashing 22 is placed around a section of the weatherhead 16 in the following steps:

a. The upper half of flashing 24 is first placed upon the decking (unnumbered) covered by felt (not shown) on the high side of the sloped roof 12 above the weatherhead 16 such that its first and second semi-cylindrical flanges 34 and 36 surround a section of the weatherhead 16.

b. The lower half of flashing 38 is next placed upon the decking (unnumbered) covered by felt (not shown) on the low side of the sloped roof 12 below the weatherhead 16 such that its first and second semi-cylindrical flanges 48 and 50 partially surround the weatherhead 16 and moved towards upper half of flashing 24 until its upwardly extending bent lip 46 engages behind downwardly extending bent lip 32 of upper half of flashing 24.

c. The roofer next uses a hammer to hit along the lower portion or edge 30 of upper half of flashing 24 to fasten bent lip 46 to bent lip 32, thus providing a water tight connection between upper half of flashing 24 and lower half of flashing 38.

d. The roofer then places rubber gasket 60 formed from a rectangular piece of rubber around the weatherhead 16 adjacent the upper opening 52 and places two-piece clamp 56 around the upper edges (unnumbered) of the first and second semi-cylindrical flanges 48 and 50 to seal the two-piece flashing 22 to weatherhead 16 by use of nuts and bolts 58.

As is apparent from FIGS. 1 and 3–5 of the drawings, the lower or oblong opening 54 formed by the overlapping first semi-cylindrical flanges 34 and 48 is substantially larger than the upper or generally cylindrical opening 52 formed by the upper portions (unnumbered) of the overlapping second semi-cylindrical flanges 36 and 50, thus allowing the lower or oblong opening 54 to become smaller or larger depending upon the pitch (slope) of the roof 12. The lower or oblong opening 54 is largest for a roof 12 having a slope (pitch) in the order of 15 degrees and smaller for a roof 12 having a slope (pitch) in the order of 75 degrees. The upper or generally cylindrical opening 52 will remain constant to a size slightly greater than the external diameter of weatherhead 16 irrespective to the slope (pitch) of the roof 12. These features permit the replacement flashing 22 of the present invention to be adaptable to all roof pitches.

The foregoing is provided for purposes of illustration, explanation, and description of the preferred embodiment of the present invention. Modifications, variations and adaptations of this embodiment will be apparent to those of ordinary skill in the art and they may be made without departing from the scope or spirit of the invention.

I claim:

1. A flashing for sealing a joint formed at a juncture of an inclined surface and an upstanding member protruding through said inclined surface, said flashing comprising:

first and second discrete complementary members disposed for mating secured relations, each complementary member having a transverse deformable edge portion provided with a cut-out section and upstanding one of the edge portions having an upwardly extending lip, and the other of the edge portions having a downwardly extending lip; flange means adjacent said cut-out section;

said complementary members disposed for placement around opposite halves of said upstanding member with said deformable edge portions being in interlocking relation, the secured relation between said complementary members being responsive to deformation of said deformable edge portions; and means for securing said first and second complementary members together to seal said first and second complementary members around a section of the upstanding member.

2. The flashing of claim 1 wherein said means for securing said first and second complementary members around the section of the upstanding member includes a resilient rubber gasket and a clamp member.

3. The flashing of claim 2 wherein said clamp member includes first and second C-shaped elements and nuts and bolts for connecting said C-shaped elements.

4. The flashing of claim 1 wherein each said upstanding flange means includes a bottom portion and a top portion which defines an opening which is larger at said bottom portion than at said top portion whereby the flashing is adaptable to inclined surfaces of a wide range of inclinations.

5. An improved prefabricated flashing unit for use in weatherproofing a roof penetration, said unit including first and second complementary mating half portions of flashing of generally rigid, high-strength, sheet metal;

said first half portion of flashing comprising an upper and lower surface, a transversely extending edge having a first semi-cylindrical opening and a downwardly extending lip, and a first semi-cylindrical flange means secured to said upper surface adjacent said semi-cylindrical opening;

said second half portion of flashing comprising an upper surface and a lower surface, a transversely extending edge having a second semi-cylindrical opening and an upwardly extending lip, and a second semi-cylindrical flange means secured to said upper surface of said second half portion of flashing adjacent said semi-cylindrical opening of said second half portion of flashing; and means for securing said first and second half portions of flashing together to seal said first and second half portions of flashing around the roof penetration.

6. The improved prefabricated flashing unit of claim 5 wherein said means for securing said first and second half portions of flashing around the roof penetration includes a resilient gasket and a clamp member.

7. The improved prefabricated flashing unit of claim 6 wherein said resilient gasket includes an elongated rubber member wrapped around the first and second half portions of flashing.

8. The improved prefabricated flashing unit of claim 7 wherein said clamp member includes first and second C-shaped elements and nuts and bolts for connecting said C-shaped elements.

9. The improved prefabricated flashing unit of claim 5 wherein said downwardly extending lip of said first half portion of flashing is secured to said upwardly extending lip of said second half portion of flashing.

10. The improved prefabricated flashing unit of claim 9 wherein each said first and second semi-cylindrical flange means of said first and second half portions of flashing includes an upstanding wall member which defines an opening for surrounding a section of the roof penetration to form an enclosure.

11. The improved prefabricated flashing unit of claim 10 wherein said enclosure has a top portion and a bottom portion, said enclosure being larger at said bottom portion than at said top portion whereby the perfabricated flashing unit is adaptable to roofs of a wide range of inclinations.

12. The improved prefabricated flashing unit of claim 11 wherein said enclosure defines an opening which is generally round at said top portion and generally oblong at said bottom portion.

13. An improved prefabricated flashing unit for use in weatherproofing a roof penetration, said flashing unit comprising:

a first half portion of generally rigid, high strength metal, and including a plate having an upper surface, a lower surface, a transversely extending edge having a cut-away edge portion, a downwardly extending lip, and a generally semi-cylindrical stack portion extending from said upper surface of said plate adjacent said cut-away portion;

a second half portion of generally rigid, high strength metal, and including a plate having an upper surface, a lower surface, a transversely extending edge having a cut-away edge portion and an upwardly extending lip, and a generally semi-cylindrical stack portion extending from said upper surface of said plate adjacent said cut-away portion;

said downwardly extending lip of said first half portion being adapted to receive said upwardly extending lip of said second half portion for tight engagement to form the flashing unit; and means for securing said generally semi-cylindrical stack portions to seal said first and second half portions of the flashing unit around the roof penetration.

14. The improved prefabricated flashing unit of claim 13 wherein said means for securing said generally semi-cylindrical stack portions of the flashing unit around the roof penetration includes a resilient gasket and a clamp member.

15. The improved prefabricated flashing unit of claim 14 wherein said resilient gasket includes an elongated rubber member wrapped around the first and second half portions of flashing.

16. The improved prefabricated flashing unit of claim 14 wherein said clamp member includes first and second C-shaped elements and nuts and bolts for connecting said C-shaped elements.

17. The improved prefabricated flashing unit of claim 13 wherein said downwardly extending lip of said first half portion of flashing is secured to said upwardly extending lip of said second half portion of flashing.

18. The improved prefabricated flashing unit of claim 17 wherein each said first and second semi-cylindrical flange means of said first and second half portions of flashing includes an upstanding wall member which defines an opening for surrounding a section of the roof penetration to form an enclosure.

19. The improved prefabricated flashing unit of claim 18 wherein said enclosure has a top portion and a bottom portion, said enclosure being larger at said bottom portion than at said top portion whereby the prefabricated flashing unit is adaptable to roofs of a wide range of inclinations.

* * * * *